US010625526B2

(12) United States Patent
Kayanaka et al.

(10) Patent No.: US 10,625,526 B2
(45) Date of Patent: Apr. 21, 2020

(54) PRINT DEVICE, CONTROL METHOD FOR PRINT DEVICE, AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya-shi, Aichi-ken (JP)

(72) Inventors: Yoshihisa Kayanaka, Kuwana (JP); Hidekazu Komiya, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/261,067

(22) Filed: Jan. 29, 2019

(65) Prior Publication Data

US 2019/0232697 A1 Aug. 1, 2019

(30) Foreign Application Priority Data

Jan. 31, 2018 (JP) ..... 2018-015078

(51) Int. Cl.
*B41J 29/393* (2006.01)
*B41J 2/045* (2006.01)
*B41J 29/02* (2006.01)

(52) U.S. Cl.
CPC ..... *B41J 29/393* (2013.01); *B41J 2/04503* (2013.01); *B41J 2/04573* (2013.01); *B41J 29/02* (2013.01)

(58) Field of Classification Search
CPC ..... B41J 29/393; B41J 29/02; B41J 2/04503; B41J 2/04573
See application file for complete search history.

(56) References Cited

U.S. PATENT DOCUMENTS

2011/0063352 A1 3/2011 Sakurada et al.
2011/0298854 A1 12/2011 Sakurada et al.
2016/0031251 A1* 2/2016 Aoi ..... B41J 2/2142 347/19
2018/0326721 A1* 11/2018 Tatsuda ..... B41J 2/04573

FOREIGN PATENT DOCUMENTS

JP 2000-071434 A 3/2000
JP 2009-143152 A 7/2009
JP 2011-079296 A 4/2011

* cited by examiner

*Primary Examiner* — Sharon A. Polk
(74) *Attorney, Agent, or Firm* — K&L Gates LLP

(57) ABSTRACT

A print device includes a first head, a second head, a platen, a guide member, a receiving portion, a processor, and a memory that stores computer-readable instructions that cause the print device to perform processes including: test printing that involves printing a test pattern by ejecting the second ink at a first timing and a second timing at a first sub-scanning direction position, and further, ejecting the second ink at a third timing and a fourth timing at a second sub-scanning direction position; and determining that involves, when one of the first and the second timing is received, determining the received timing to be the ejection timing of the second ink at the first sub-scanning direction position, and, when one of the third and the fourth timing is received, determining the received timing to be the ejection timing of the second ink at the second sub-scanning direction position.

9 Claims, 10 Drawing Sheets

FIG. 9A

| COORDINATES | MATCHING POSITION |
|---|---|
| YPOS1 | 1 |
| YPOS2 | 0 |
| YPOS3 | -2 |
| YPOS4 | -1 |
| YPOS5 | 1 |

FIG. 9B

| REGION | CORRECTION VALUE |
|---|---|
| REGION 1 | CORRECTION VALUE FOR YPOS1 |
| REGION 2 | INTERPOLATED VALUE OF YPOS1 AND YPOS2 |
| REGION 3 | INTERPOLATED VALUE OF YPOS2 AND YPOS3 |
| REGION 4 | INTERPOLATED VALUE OF YPOS3 AND YPOS4 |
| REGION 5 | INTERPOLATED VALUE OF YPOS4 AND YPOS5 |
| REGION 6 | CORRECTION VALUE FOR YPOS5 |

PRINT DEVICE, CONTROL METHOD FOR PRINT DEVICE, AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2018-15078 filed Jan. 31, 2018. The contents of the foregoing application are hereby incorporated herein by reference.

BACKGROUND

The present disclosure relates to a print device, a control method of a print device, and a non-transitory computer-readable medium storing computer-readable instructions.

In the past, there is known a print device that includes a platen that supports a recording medium, a head portion that ejects ink, and a carriage on which the head portion is mounted. The print device performs printing by ejecting ink onto the recording medium, while moving the carriage in a main scanning direction and moving the platen in a sub-scanning direction. If the print device is relatively large, the scanning distance of the carriage is long. Therefore, a rail that guides the carriage in the main scanning direction, and the platen that supports the recording medium, may curve or bend slightly, thereby causing the recording position to deviate.

In order to solve this problem, a print device described in Japanese Laid-Open Patent Publication No. 2009-143152 prints a test pattern at a plurality of positions in the main scanning direction of the carriage, and measures the amount of deviation of the recording positions of dots corresponding to each position, from this test pattern. Also, this print device adjusts the ink ejection timing in the outgoing path and the ink ejection timing in the return path in the main scanning direction, on the basis of this amount of deviation of the recording positions.

SUMMARY

This print device only prints a test pattern in a plurality of positions in the main scanning direction of the carriage, and adjusts the ink ejection timing in the outgoing path and the ink ejection timing in the return path in the main scanning direction of the carriage. Therefore, if a guide member that guides the platen in the sub-scanning direction bends, the amount of deviation of the recording positions of the dots cannot adjusted, which is problematic. Also, in a print device that includes a first head that ejects a first ink and a second head that ejects a second ink, the landing position of the second ink will deviate from the landing position of the first ink, which is problematic, if the guide member that guides the platen in the sub-scanning direction is bent.

Embodiments of the broad principles derived herein provide a print device including a first head that ejects a first ink and a second head that ejects a second ink, which reduces deviation of a landing position of the second ink with respect to a landing position of the first ink regardless of the position of a platen, a control method for a print device, and a non-transitory computer-readable medium storing computer-readable instructions.

A print device according to a first aspect of the present disclosure includes a first head that moves in a main scanning direction and ejects a first ink; a second head that moves in the main scanning direction and ejects a second ink; a platen on which a recording medium is placed; a guide member that extends in a sub-scanning direction and guides the platen in the sub-scanning direction; a receiving portion that receives an ejection timing of the second ink; a processor; and a memory that stores computer-readable instructions that, when executed by the processor, cause the print device to perform processes including: test printing that involves printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and determining that involves, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

In this case, in the test printing, the second ink is ejected at the first timing and the second timing at the first sub-scanning direction position where the first ink was ejected. Also, in the test printing, the second ink is ejected at the third timing and the fourth timing at the second sub-scanning direction position where the first ink was ejected. The print device can receive, via the receiving portion, one timing at which the deviation of the landing position of the second ink with respect to the landing position of the first ink is relatively reduced, at the first sub-scanning direction position and the second sub-scanning direction position. Therefore, the print device can reduce the deviation of the landing position of the second ink with respect to the landing position of the first ink, at the first sub-scanning direction position and the second sub-scanning direction position.

A control method of a print device according to a second aspect of the present disclosure is a control method of a print device including a first head that moves in a main scanning direction and ejects a first ink, a second head that moves in the main scanning direction and ejects a second ink, a platen on which a recording medium is placed, a guide member that extends in a sub-scanning direction and guides the platen in the sub-scanning direction, a receiving portion that receives an ejection timing of the second ink, and a processor. The control method includes the following steps: a test printing step of printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and a determining step of, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

In this case, in the test printing step, the second ink is ejected at the first timing and the second timing at the first sub-scanning direction position where the first ink was ejected. Also, in the test printing step, the second ink is ejected at the third timing and the fourth timing at the second sub-scanning direction position where the first ink was ejected. The print device can receive, via the receiving portion, one timing at which the deviation of the landing position of the second ink with respect to the landing position of the first ink is relatively reduced, at the first sub-scanning direction position and the second sub-scanning direction position. Therefore, the print device can reduce the deviation of the landing position of the second ink with respect to the landing position of the first ink, at the first sub-scanning direction position and the second sub-scanning direction position.

A non-transitory computer-readable medium storing computer-readable instructions according to a third aspect of the present disclosure is a non-transitory computer-readable medium storing computer-readable instructions that, when executed by a processor of a print device including a first head that moves in a main scanning direction and ejects a first ink, a second head that moves in the main scanning direction and ejects a second ink, a platen on which a recording medium is placed, a guide member that extends in a sub-scanning direction and guides the platen in the sub-scanning direction, a receiving portion that receives an ejection timing of the second ink, and the processor, cause the print device to perform processes including: test printing that involves printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and determining that involves, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

In this case, in the test printing, the second ink is ejected at the first timing and the second timing at the first sub-scanning direction position where the first ink was ejected. Also, in the test printing, the second ink is ejected at the third timing and the fourth timing at the second sub-scanning direction position where the first ink was ejected. The print device can receive, via the receiving portion, one timing at which the deviation of the landing position of the second ink with respect to the landing position of the first ink is relatively reduced, at the first sub-scanning direction position and the second sub-scanning direction position. Therefore, the print device can reduce the deviation of the landing position of the second ink with respect to the landing position of the first ink, at the first sub-scanning direction position and the second sub-scanning direction position.

BRIEF DESCRIPTION OF THE DRAWINGS

Exemplary embodiments will be described below in detail with reference to the accompanying drawings in which:

FIG. 9A is a chart of the matching positions of YPOS1 to YPOS5, and FIG. 9B is a chart of the correction values for a first region to a sixth region.

DETAILED DESCRIPTION

Figure 1:
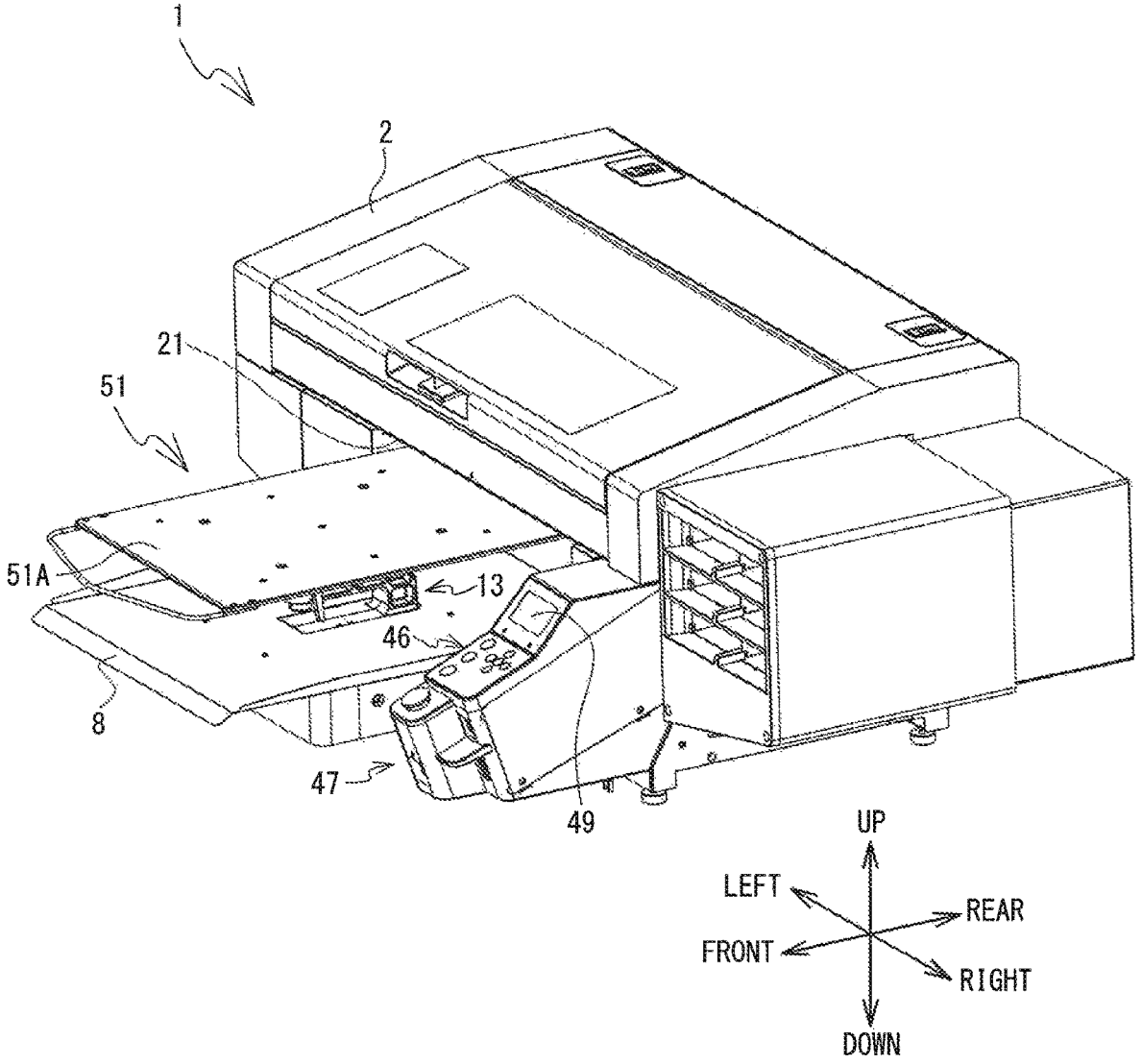
FIG. 1 is a perspective view of a print device

The configuration of a print device 1 according to a first embodiment of the present disclosure will be described with reference to FIG. 1 to FIG. 9. The upper side, the lower side, the lower left side, the upper right side, the lower right side, and the upper left side of FIG. 1 are the upper side, the lower side, the front side, the rear side, the right side, and the left side, respectively, of the print device 1.

Mechanical Configuration of the Print Device 1

The print device 1 is an inkjet printer that performs printing by ejecting liquid from head units 100 and 200 onto a print medium (not shown in the drawings) such as the cloth of a T-shirt, or paper, or the like. For example, the print device 1 prints a color image on the print medium by downwardly ejecting five mutually different types of the ink (white (W), black (K), yellow (Y), cyan (C), and magenta (M)) as liquid. In the following explanation, of the five types of ink, the white ink is referred to as white ink, and when the inks of the four colors of black, cyan, yellow, and magenta are collectively referred to, they are referred to as color ink.

When the print device 1 ejects color ink onto cloth, the white ink is ejected first as the basic ink to reduce the effect of fabric color or material, and then the color ink is ejected on top of the white ink. If there is deviation between the landing position of the basic ink and the landing position of the color ink, the basic ink will tend to stand out at the area where the deviation has occurred. In particular, the white ink has a higher lightness value than the color ink, so the white ink at the area where the deviation has occurred will tend to stand out. With the print device 1, even if a head portion 110 and a head portion 210, which will be described later, have deviated from predetermined positions due to bending of guide rails 11 and 12, which will also be described later, or the like, deviation between the landing position of the white ink and the landing position of the color ink is reduced by relatively correcting the landing positions of the white ink and the color ink that are to be ejected.

Figure 2:
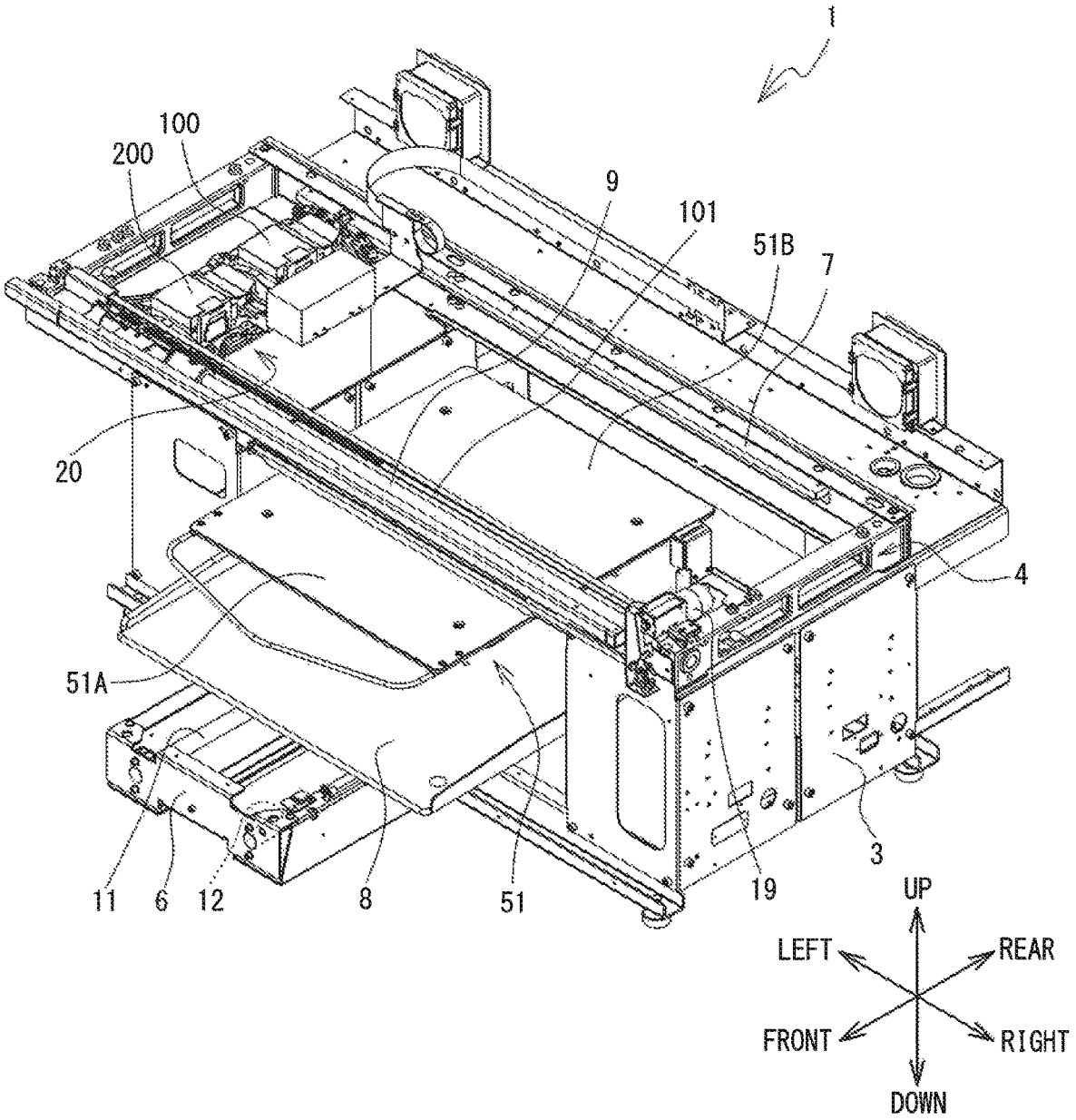
FIG. 2 is a perspective view of the print device with a housing removed.

As shown in FIG. 1 and FIG. 2, the print device 1 includes a housing 2, a base portion 3, a frame body 4, a guide shaft 9, a rail 7, a carriage 20, the head units 100 and 200, a drive belt 101, a drive motor 19, a platen drive mechanism 6, a platen 51, and a tray 8.

Figure 3:
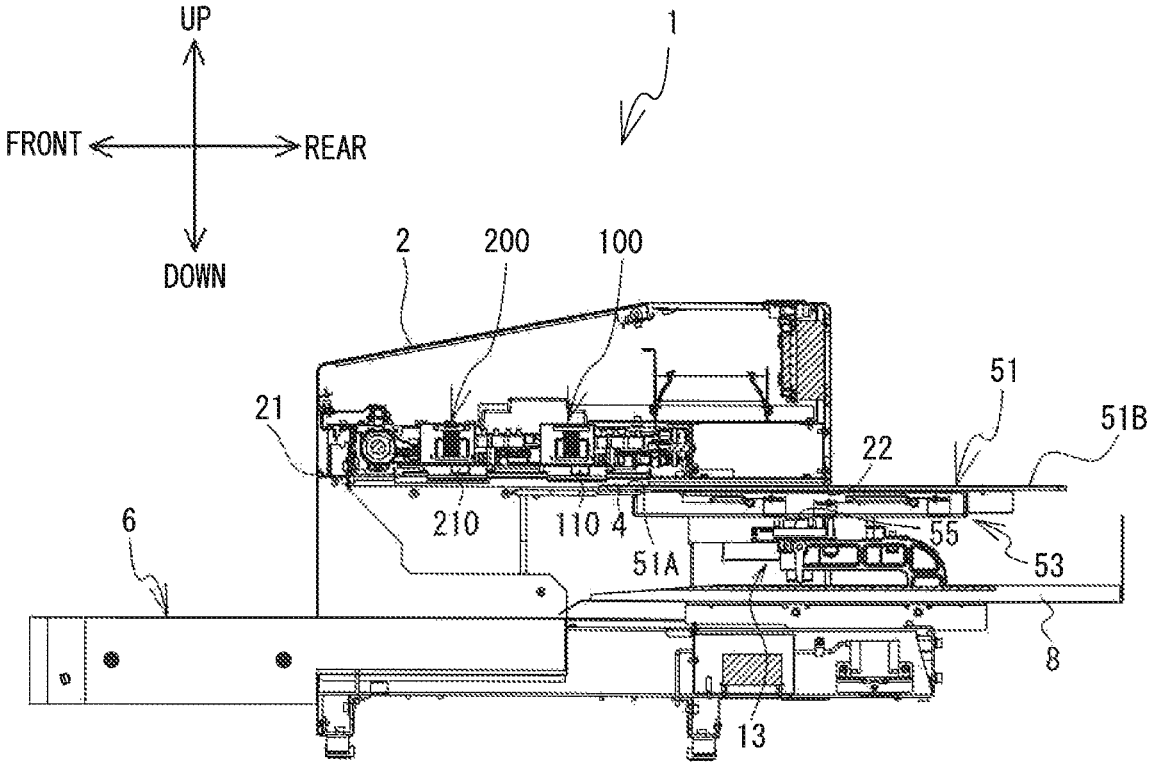
FIG. 3 is a sectional view of the print device when a platen support base is in a printing position.

As shown in FIG. 1 to FIG. 3, the housing 2 has a box shape having openings 21 and 22 on both the front side and the back side. The housing 2 houses the head units 100 and 200. An operation portion 47 is provided at a position on the right front side of the housing 2. The operation portion 47 includes a display 49 and operation buttons 46. The operation buttons 46 are operated by a user to input commands relating to various operations of the print device 1. The display 49 is a liquid crystal display (LCD) capable of displaying various information.

The base portion 3 and the frame body 4 are housed inside the housing 2. The frame body 4 has a frame shape that has a substantially rectangular shape in a plan view, and is installed on an upper portion of the base portion 3. The frame body 4 supports the guide shaft 9 on the front side thereof, and the rail 7 on the rear side thereof, respectively. The guide shaft 9 extends in the left-right direction inside the frame body 4. The rail 7 is disposed facing the guide shaft 9 and extends in the left-right direction.

The carriage 20 is supported so as to be able to be conveyed along the guide shaft 9 in the left-right direction. As shown in FIG. 2 and FIG. 3, the head units 100 and 200 are mounted on the carriage 20 so as to be aligned in the front-rear direction. The head unit 100 is positioned further to the rear than the head unit 200. As shown in FIG. 3, the head portions 110 and 210 are provided on lower portions of the head units 100 and 200, respectively. The head portion 110 of the head unit 100 ejects the white ink. The head portion 210 of the head unit 200 ejects the color ink.

The drive belt 101 is stretched along the left-right direction on the inside of the frame body 4. The drive motor 19 is coupled to the carriage 20 via the drive belt 101. As the drive motor 19 drives the drive belt 101, the carriage 20 is moved in a reciprocating manner in the left-right direction (main scanning direction) along the guide shaft 9.

The platen drive mechanism 6 is provided with the pair of guide rails 11 and 12 and a platen support base 13. The pair of guide rails 11 and 12 extend in the front-rear direction, and support the platen support base 13 such that the platen support base 13 can move in the front-rear direction (sub-scanning direction). The pair of guide rails 11 and 12 pass through the housing 2 by being inserted through the openings 21 and 22 of the housing 2. The platen support base 13 supports the platen 51. The length of the guide rails 11 and 12 is approximately 1 m, for example. The platen support base 13 of this example supports the platen 51 in such a way that the platen 51 can be removed. By driving the platen drive mechanism 6, the platen support base 13 can move between a print position for printing onto the print medium, and a removal position for removing the print medium from the platen 51.

One example of the print position and the removal position will be described below. The print position is a position where the platen 51 faces the head portions 110 and 210, as illustrated in FIG. 3. The removal position is the position shown in FIG. 1, in which the platen support base 13 and the platen 51 have reached front end portions of the pair of guide rails 11 and 12. In the removal position, the platen support base 13 is disposed outside the housing 2. The platen 51 is able to have the print medium placed thereon. The platen 51 has a predetermined thickness, and has a rectangular plate shape with the front-rear direction being the longitudinal direction. At the time of printing, the print medium is placed on the platen 51, and the platen 51 is conveyed in the sub-scanning direction, so the print medium is also conveyed in the sub-scanning direction.

The tray 8 is provided below the platen 51. The tray 8 receives the sleeves and the like of the T-shirt when the operator places the T-shirt or the like on the platen 5, thus protecting the sleeves and the like from coming into contact with other components inside the housing 2.

Electrical Configuration of the Print Device 1

The electrical configuration of the print device 1 will be described with reference to FIG. 4. The print device 1 includes a CPU 40 that controls the print device 1. ROM 41, RAM 42, a head drive portion 43, a main scanning drive portion 44, a sub-scanning drive portion 45, an ASIC 18, a display control portion 48, and an operation processing portion 50 are all electrically connected to the CPU 40 via a bus 39.

A control program for the CPU 40 to control the operation of the print device 1, and initial values, and the like, are stored in the ROM 41. Various data used by the control program is temporarily stored in the RAM 42. The head drive portion 43 is electrically connected to the head portions 110 and 210 that eject the ink, and causes the ink to be ejected from nozzles by driving piezoelectric elements provided in ejection channels of the head portions 110 and 210 (refer to FIG. 3).

The main scanning drive portion 44 includes the drive motor 19 (refer to FIG. 2) and causes the carriage 20 to move in the main scanning direction. The sub-scanning drive portion 45 drives the platen drive mechanism 6 (refer to FIG. 2) so as to cause the platen 51 (refer to FIG. 1) to move in the sub-scanning direction. The ASIC 18 controls the head drive portion 43, the main scanning drive portion 44, and the sub-scanning drive portion 45.

First Ejection Timing Adjustment Processing

First ejection timing adjustment processing executed by the CPU 40 will be described with reference to FIG. 5. In the following example, the resolution of the head portions 110 and 210 is described as 1200 dpi as an example. A command signal to start test printing is input to the CPU 40 from the operation processing portion 50 in response to the operation buttons 46 being operated. When the CPU 40 detects the input of the command signal to start test printing (yes at step S1), the CPU 40 executes test printing (step S2). The CPU 40 prints a correction pattern 60 for test printing (refer to FIG. 6) on the print medium. Test printing differs from normal printing only with respect to the print data; the print operation is the same as that in normal printing. One example of a print medium for test printing is special black paper (not shown in the drawing, and hereinafter referred to as a "test sheet"). Deviation between the white ink and the color ink tends to stand out on the special black paper. If the CPU 40 does not detect the input of the command signal to start test printing (no at step S1), the CPU 40 returns the processing to step S1.

In the test printing (step S2), the CPU 40 executes well-known print processing by controlling the head drive portion 43, the main scanning drive portion 44, and the sub-scanning drive portion 45 via the ASIC 18, in accordance with the test print data (step S2). As one example, the platen drive mechanism 6 is driven by the sub-scanning drive portion 45 to move the platen support base 13 and the platen 51 in the sub-scanning direction along the pair of guide rails 11 and 12. The carriage 20 moves in the main scanning direction along the guide shaft 9 by the main scanning drive portion 44. In response to the head drive portion 43 being driven, the head portion 110 ejects the white ink onto the test sheet, and the head portion 210 ejects the color ink onto the test sheet. Accordingly, the correction pattern 60 that will be described later is printed onto the test sheet.

Correction Pattern 60

Figure 6:
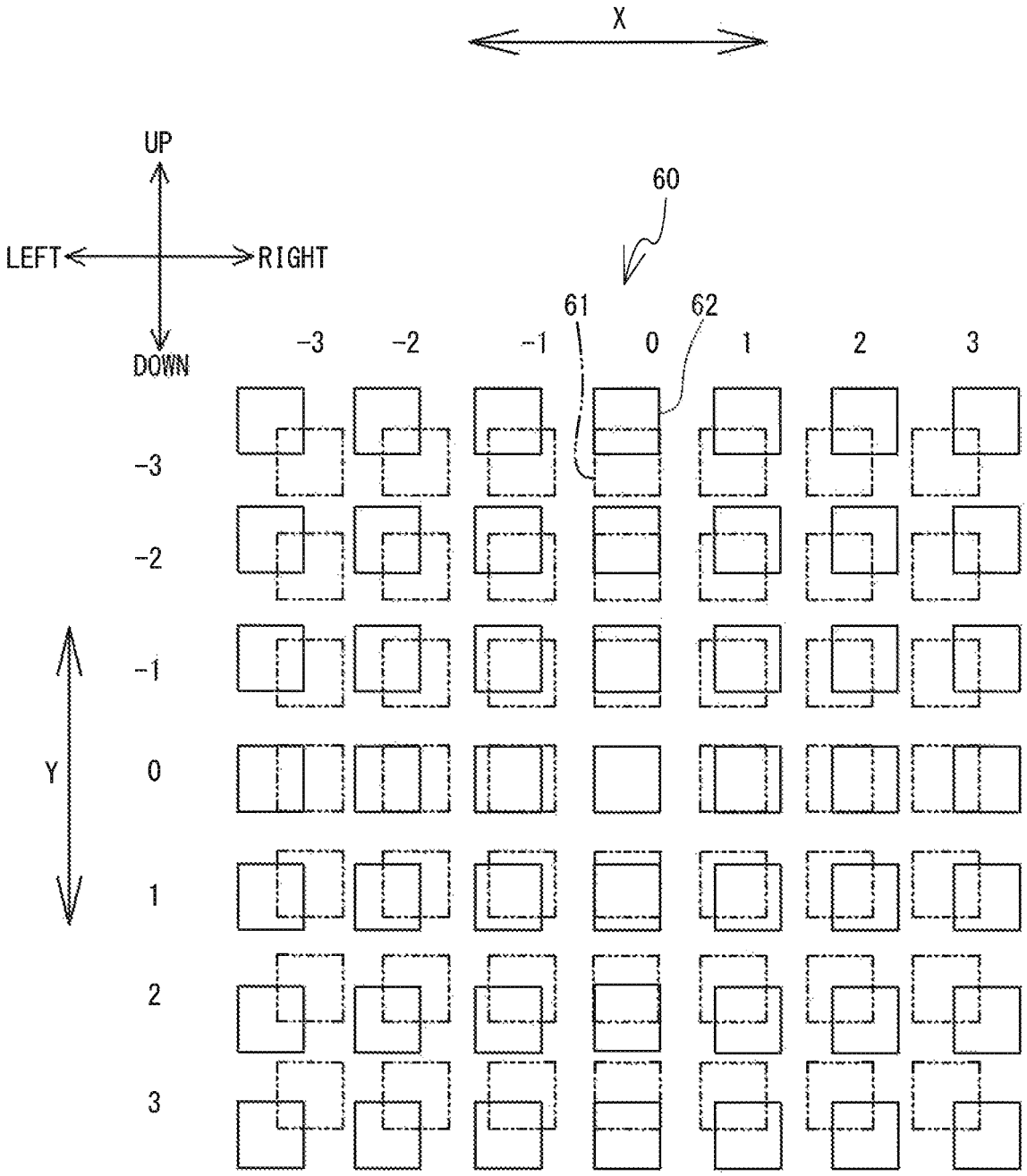
FIG. 6 is a plan view illustrating a correction pattern.

Next, an example of the correction pattern 60 printed in the test printing will be described with reference to FIG. 6. In FIG. 6, the left-right direction is the main scanning direction, and will also be referred to as the "X direction" below. The up-down direction is the sub-scanning direction, and will also be referred to as the "Y direction" below. The correction pattern 60 is a print pattern for determining whether the landing position of the white ink and the landing position of the color ink are deviating from predetermined landing positions. FIG. 6 shows the correction pattern 60 printed when the landing positions from the head portions 110 and 210 are not deviating from the predetermined landing positions. The correction pattern 60 is formed by a plurality of first rectangles 61 and second rectangles 62. The first rectangles 61 are indicated by alternate long and two short dashes lines, and are printed with white ink. Also, the rectangles 62 are indicated by solid lines, and are printed with color ink. For example, the first rectangles 61 may be squares having sides extending in the main scanning direction and the sub-scanning direction. Seven of the first rectangles 61 are printed at equidistant intervals in the main scanning direction and the sub-scanning direction, for example.

The rectangles 62 may be squares that are the same size and shape as the first rectangles 61, and have sides extending in the main scanning direction and the sub-scanning direction, for example. Seven of the second rectangles 62 are printed at equidistant intervals in the main scanning direction and the sub-scanning direction, for example. In FIG. 6, one correction pattern 60 is shown, but in actuality, a plurality of the correction patterns 60 are printed in the main scanning direction and a plurality of columns of correction patterns 60 are printed in the sub-scanning direction on the test sheet.

The resolution of the head portions 110 and 210 is 1200 dpi, so one pixel is 1/1200 (inch), and the line widths of the first rectangles 61 and the second rectangles 62 may be two pixels (2/1200 (inch)) to make them easier to see. In the correction pattern 60, the position of the first rectangles 61 printed at the center is defined as coordinates (0, 0), and the positions of −3 to 3 are defined from left to right in the X direction, and the positions of −3 to 3 are defined from up to down in the Y direction. Therefore, the position of the first rectangle 61 on the uppermost left end in the correction pattern 60 has the coordinates (−3, −3), and the position of the first rectangle 61 on the lowermost right end in the correction pattern 60 has the coordinates (3, 3). The same is also true for the second rectangles 62.

With the second rectangles 62, the position of the second rectangle 62 printed at the center is defined as coordinates (0, 0). When the head portion 110 and the head portion 210 are in the correct positional relationship, the second rectangle 62 is printed in the same position as the first rectangle 61, without deviating from the first rectangle 61, at the coordinates (0, 0). The landing position of the second rectangle 62 deviates in increments of 2/1200 (inch) from the coordinates (0, 0) as the coordinates move up and down and left and right. For example, the second rectangle 62 printed at coordinates (1, 0) deviates 2/1200 (inch) to the right with respect to the first rectangle 61 at coordinates (1, 0). The second rectangle 62 printed at coordinates (2, 0) deviates 4/1200 (inch) to the right with respect to the first rectangle 61 at coordinates (2, 0). The second rectangle 62 printed at coordinates (3, 0) deviates 6/1200 (inch) to the right with respect to the first rectangle 61 at coordinates (3, 0). Also, the second rectangle 62 printed at coordinates (−1, 0) deviates 2/1200 (inch) to the left with respect to the first rectangle 61 at coordinates (−1, 0). The second rectangle 62 printed at coordinates (−2, 0) deviates 4/1200 (inch) to the left with respect to the first rectangle 61 at coordinates (−2, 0). The second rectangle 62 printed at coordinates (−3, 0) deviates 6/1200 (inch) to the left with respect to the first rectangle 61 at coordinates (−3, 0). The same is also true in the up-down direction. Therefore, the second rectangle 62 printed at coordinates (3, 3) deviates 6/1200 (inch) to the right and 6/1200 (inch) down with respect to the first rectangle 61 at coordinates (3, 3). The second rectangle 62 printed at coordinates (−3, −3) deviates 6/1200 (inch) to the left and 6/1200 (inch) up with respect to the first rectangle 61 at coordinates (−3, −3).

When the head portion 110 and the head portion 210 are in the correct positional relationship, for example, when the bend of the guide rails 11 and 12 is within the tolerance and the positions of the head portion 110 and the head portion 210 are at predetermined positions, the correction pattern 60 in the state shown in FIG. 6 is printed. That is, only at coordinates (0, 0) is the second rectangle 62 printed overlapping directly over the first rectangle 61 with no deviation therebetween, such that the first rectangle 61 of white ink is not able to be seen and only the second rectangle 62 of color ink is visible. The other parts are printed with the second rectangles 62 of color ink deviating from the first rectangles 61 of white ink, as shown in FIG. 6.

Next, for example, a case will be described in which the guide rails 11 and 12 are bent such that the head portion 110 and the head portion 210 are not in the correct positional relationship. One example of when the head portion 110 and the head portion 210 are not in the correct positional relationship is when the head portion 110 and the head portion 210 are not in the predetermined positions due to bend in the guide rails 11 and 12. In this case, when the correction pattern 60 is printed, the correction pattern 60 is printed in a state that is different from the state shown in FIG. 6. That is, the portion where the second rectangle 62 is printed overlapping directly over the first rectangle 61 is not at coordinates (0, 0), but rather at a different position. For example, the second rectangle 62 is printed directly over the first rectangle 61 that is printed at the position of coordinates (2, 0), so the first rectangle 61 that is printed in white ink is not visible. In this case, the positional relationship of the head portion 110 and the head portion 210 is as described below.

Up-down direction (Y direction): In the correct positional relationship. That is, there is a predetermined distance between the heads.

Left-right direction (X direction): The head portion 210 is positioned to the left side of the head portion 110 by 4/1200 (inch).

Thus, the coordinates of the portion where the second rectangle 62 is printed overlapping directly above, without deviating from, the first rectangle 61 become information indicative of the positional relationship of the head portions. Therefore, when ink is ejected, the landing positions of the white ink ejected from the head portion 110 and the color ink ejected from the head portion 210 can be made to match by moving the ink ejection timings, using the information of the positional relationship of the head portions described above. For example, when the second rectangle 62 is printed directly over the first rectangle 61 that is printed at the position of coordinate (2, 0), the position of the second rectangle 62 is off to the left by 4/1200 (inch) from the first rectangle 61. Therefore, the landing position of the color ink can be corrected to the correct landing position by moving the ejection timing of the color ink from the head portion 210 to the right 4/1200 (inch). Note that when printing at a resolution of 1200 (dpi), the ejection timing will be moved 4/1200 (inch) if the ejection timing is moved by an amount corresponding to 4 dots. Note that the function of moving the ejection timings of the head portion 110 and the head portion 210 is a function for matching the landing positions of the ink in reciprocation printing, and is controlled by the ASIC 18.

Figure 7:
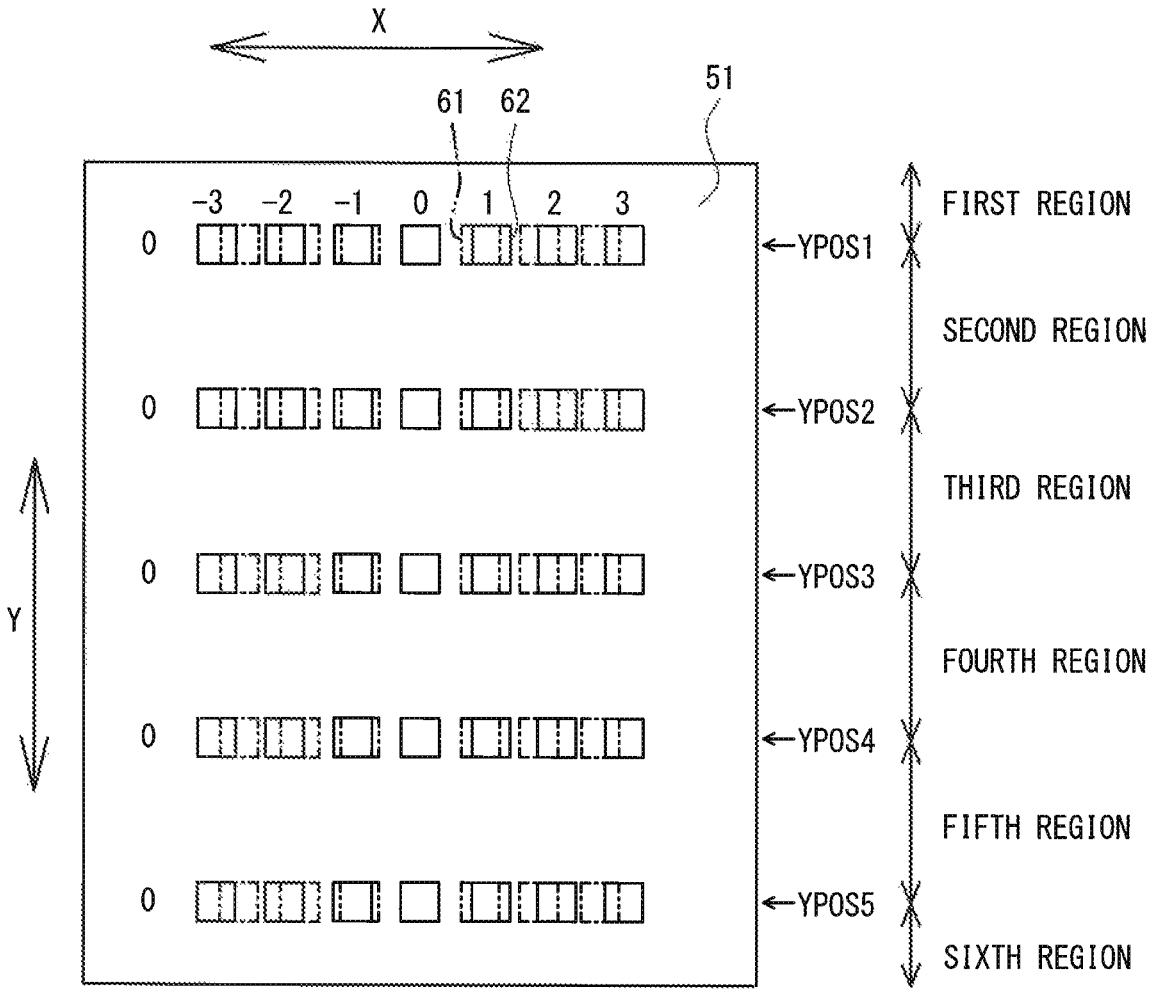
FIG. 7 is a view explaining alignment of the landing positions of white ink and color ink on a platen.

Next, landing position matching of the white ink and the color ink on the upper surface of the platen 51 will be described with reference to FIG. 7 to FIG. 9. As shown in FIG. 7, the upper surface of the platen 51 is divided into six regions, i.e., a first region to a sixth region, for example, in the sub-scanning direction (Y direction). The second region to the fifth region each has the same width in the Y direction. The first region is a region on a front end 51A side of the platen 51. The sixth region is a region on a rear end 51B side of the platen 51. The first region and the sixth region may be shorter in the Y direction than the second region to the fifth region, respectively. In this case, the first region and the sixth region are both end portions of the platen 51, where interpolated values from interpolation processing, described later, are unable to be used. Therefore, the first region and the sixth region are shorter in the Y direction than the second region to the fifth region where interpolated values from interpolation processing can be used, and thus have fewer portions where the correction accuracy is poor.

The coordinate in the Y direction at the boundary between the first region and the second region on the platen 51 will be referred to as YPOS1. Similarly, the coordinate at the boundary between the second region and the third region will referred to as YPOS2. The coordinate at the boundary between the third region and the fourth region will be referred to as YPOS3. The coordinate at the boundary between the fourth region and the fifth region will be referred to as YPOS4. The coordinate at the boundary between the fifth region and the sixth region will referred to as YPOS5. In this embodiment, the landing position matching of the white ink and the color ink in the X direction is performed at a plurality of locations on the platen 51. For example, the landing position matching of the white ink and the color ink in the main scanning direction (X direction) is performed at each of YPOS1 to YPOS5.

Note that YPOS1 to YPOS5 are positions where the white ink is ejected from the head portion 110 and the color ink is ejected from the head portion 210, within a range where the platen 51 is positioned below the head portion 110 or the head portion 210, in the test printing (step S2). Also, YPOS1 to YPOS5 are positions where the white ink is ejected from the head portion 110 and the color ink is ejected from the head portion 210, within a range from a position where the front end 51A of the platen 51 in the movement direction of the platen 51 is positioned below the head portion 110 to a position where the rear end 51B of the platen 51 is positioned below the head portion 210, in the test print (step S2).

On the platen 51 shown in FIG. 7, the correction pattern 60 is printed on a test sheet, not shown, at each of the positions YPOS1 to YPOS5. In FIG. 7, the rows other than the row of the first rectangle 61 and the second rectangle 62 at coordinate 0 in the Y direction of the correction pattern 60 are omitted due to the nature of the drawing. Also, in FIG. 7, the first rectangle 61 and the second rectangle 62 are drawn larger than actual size to make them easier to see. As shown in FIG. 7, when the head portion 110 and the head portion 210 are in predetermined positions, the landing positions of the white ink and the color ink overlap at the position of coordinates (0, 0) of the correction pattern 60, at each of YPOS1 to YPOS5. Therefore, the first rectangle 61 and the second rectangle 62 printed at coordinates (0, 0) overlap and do not deviate from each other.

Figure 8:
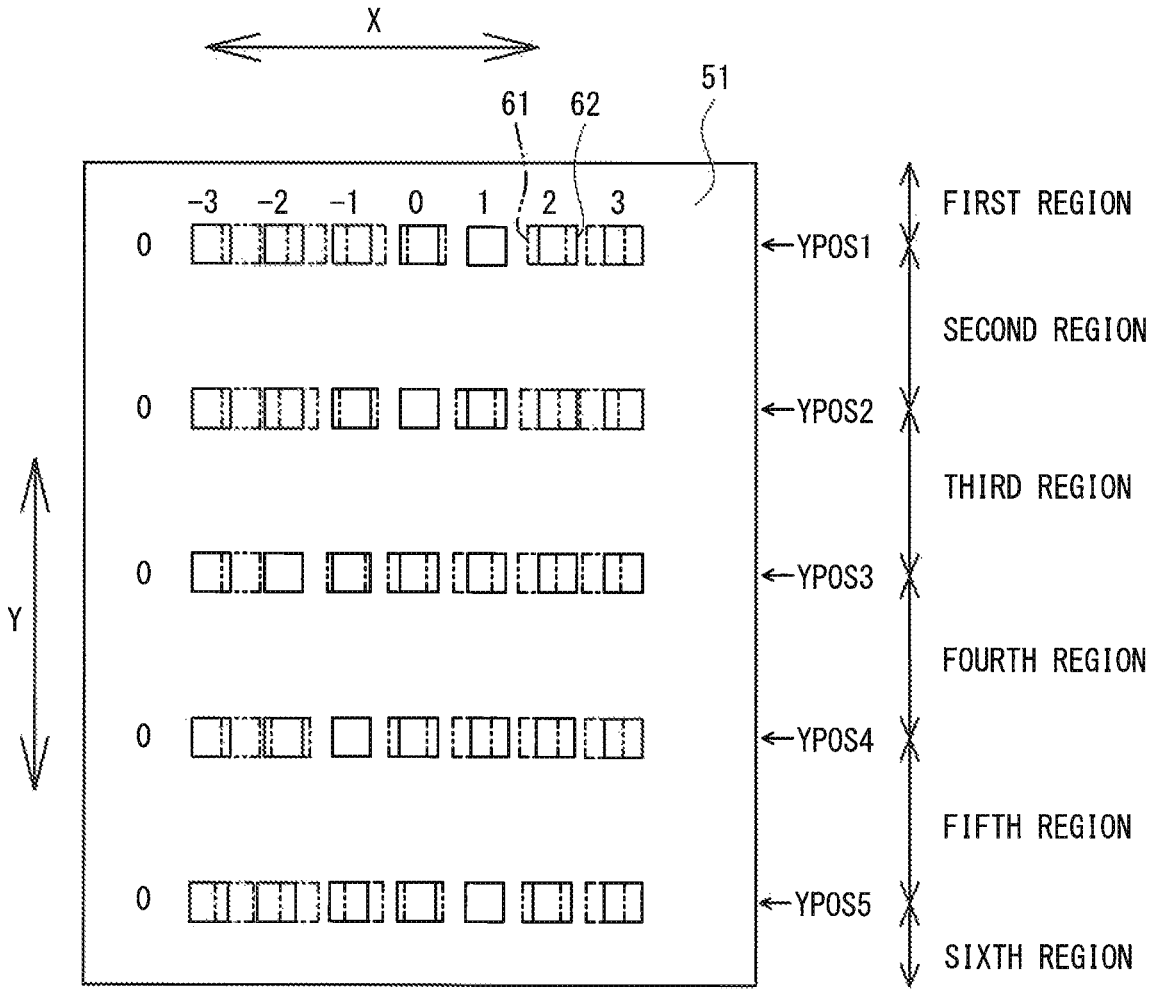
FIG. 8 is a view explaining the alignment of the landing positions of white ink and color ink on the platen.

As shown in FIG. 8, when the head portion 110 and the head portion 210 are not in the correct positional relationship, there are cases where the landing positions of the white ink and the color ink overlap at a position other than the coordinates (0, 0) of the correction pattern 60, at each of YPOS1 to YPOS5. For example, at YPOS1, the second rectangle 62 overlaps directly over the first rectangle 61 at the position of coordinates (1, 0). At YPOS2, the second rectangle 62 overlaps directly over the first rectangle 61 at the position of coordinates (0, 0). At YPOS3, the second rectangle 62 overlaps directly over the first rectangle 61 at the position of coordinates (−2, 0). At YPOS4, the second rectangle 62 overlaps directly over the first rectangle 61 at the position of coordinates (−1, 0). At YPOS5, the second rectangle 62 overlaps directly over the first rectangle 61 at the position of coordinates (1, 0). In the description below, the position where the second rectangle 62 overlaps directly over the first rectangle 61 in the X direction on the correction pattern 60 will also be referred to as the "matching position".

As shown in FIG. 8 and FIG. 9A, the matching position in the X direction on the correction pattern 60 is "1" at YPOS1, the matching position is "0" at YPOS2, the matching position is "−2" at YPOS3, the matching position is "−1" at YPOS4, and the matching position is "1" at YPOS5. Therefore, the correction value that moves the ejection timing of the color ink ejected from the head portion 210 is +2/1200 (inch) at YPOS1. Also, the correction value is 0 at YPOS2, and −4/1200 (inch) at YPOS3. Also, the correction value is −2/1200 (inch) at YPOS4. Also, the correction value is +2/1200 (inch) at YPOS5.

Next, the correction values of the ejection timings of the color ink in the X direction in the first region to the sixth region will be described with reference to FIG. 9B. For example, in the first region, the correction value for YPOS1 is used. In the second region, an interpolated value obtained by interpolating the correction value for YPOS1 and the correction value for YPOS2 is used. The interpolation processing used to obtain the interpolated value will be described later. In the third region, an interpolated value of the correction value for YPOS2 and the correction value for YPOS3 is used. In the fourth region, an interpolated value of the correction value for YPOS3 and the correction value for YPOS4 is used. In the fifth region, an interpolated value of the correction value for YPOS4 and the correction value for YPOS5 is used. In the sixth region, the correction value for YPOS5 is used.

After the test printing (step S2), the CPU 40 controls the display control portion 48 to display a correction value input screen prompting the input of the correction values for YPOS1 to YPOS5, on the display 49 (step S3). Next, the CPU 40 determines whether the correction values have been received (step S4). The user checks the printed correction pattern 60 and inputs the correction values for YPOS1 to YPOS5 by operating the operation buttons 46. When the correction values for YPOS1 to YPOS5 that have been input using the operation buttons 46 are received via the operation processing portion 50, the CPU 40 then determines that the correction values have been received (yes at step S4). For the correction values input in the processing of step S4, the coordinates of the matching positions are input to facilitate inputting. For example, a correction value of "1" is input at YPOS1, a correction value of "0" is input at YPOS2, a correction value of "−2" is input at YPOS3, a correction value of "1" is input at YPOS4, and a correction value of "−1" is input at YPOS5.

When the correction values for YPOS1 to YPOS5 that have been input using the operation buttons 46 are received via the operation processing portion 50 (yes at step S4), the CPU 40 performs ejection timing determination processing (step S5). The correction value of "0" that was received in the processing of step S4 indicates that the ink landing position of the color ink from the head portion 210 is not to be moved. The correction value of "1" indicates that the ink landing position of the color ink from the head portion 210 is to be moved 2/1200 (inch) to the right in the X direction. Also, the correction value of "−1" indicates that the ink landing position of the color ink from the head portion 210 is to be moved 2/1200 (inch) to the left in the X direction. Also, the correction value of "−2" indicates that the ink landing position of the color ink from the head portion 210 is to be moved 4/1200 (inch) to the left in the X direction.

In the ejection timing determination processing (step S5), first, the CPU 40 determines a correction value that is the amount that the landing position of the color ink from the head portion 210 at YPOS1 to YPOS5 is to be moved, on the basis of the inputting of the correction values for YPOS1 to YPOS5 received in the processing of step S3. Hereinafter, the correction value for the ink landing position will be described with the right direction in the X direction as positive and the left direction as negative. Therefore, the CPU 40 determines the correction value for YPOS1 to be "+2/1200 (inch)", the correction value for YPOS2 to be "0", the correction value for YPOS3 to be "−4/1200 (inch)", the correction value for YPOS4 to be "−2/1200 (inch)", and the correction value for YPOS5 to be "+2/1200 (inch)".

Next, the CPU 40 determines the correction values of the ejection timings of the color ink in the first region to the sixth region. for example, the first region is a region on the front end 51A side of the platen 51, so interpolated values of two locations cannot be used. Therefore, the CPU 40 determines the correction value for YPOS1 to be the correction value for first region. For example, the CPU 40 determines "+2/1200 (inch)" to be the correction value for first region.

Next, the CPU 40 uses correction values based on interpolation processing as the correction values of the second region to the fifth region. The example of interpolation processing is linear interpolation. For example, in the second region, the CPU 40 obtains the correction values by linear interpolation of the correction value "+2/1200 (inch)" for YPOS1 and the correction value "0" for YPOS2, as a correction value d with respect to coordinate y in the Y direction on the platen 51 in the second region. For example, the CPU 40 executes a linear interpretation calculation by following Equation 1 below.

$$d=d0+(d1-d0)/(y1-y0)\times(y-y0) \qquad \text{Equation 1}$$

where y: Y coordinate on the platen 51, y0: Y coordinate of YPOS1, y1: Y coordinate of YPOS2, d0: correction value (+2/1200 (inch)) for YPOS1, d1: correction value (0) for YPOS2, and d: correction value at y.

Next, the CPU 40 obtains the correction value for the third region using Equation 1 in the same manner as described above. The CPU 40 obtains the correction value for the third region by inputting, in Equation 1, y0: Y coordinate of YPOS2, y1: Y coordinate of YPOS3, and d0: correction value (0) of YPOS2, d1: correction value (−4/1200 (inch)) of YPOS3.

Next, the CPU 40 obtains the correction value for the fourth region using Equation 1 in the same manner as described above. The CPU 40 obtains the correction value for the fourth region by inputting, in Equation 1, y0: Y coordinate of YPOS3, y1: Y coordinate of YPOS4, d0: correction value (−4/1200 (inch)) of YPOS3, and d1: correction value (−2/1200 (inch)) of YPOS4.

Next, the CPU 40 obtains the correction value for the fifth region using Equation 1 in the same manner as described above. The CPU 40 obtains the correction value for the fifth region by inputting, in Equation 1, y0: Y coordinate of YPOS4, y1: Y coordinate of YPOS5, d0: correction value (−2/1200 (inch)) for YPOS4, and d1: correction value (+2/1200 (inch)) for YPOS5.

Next, the CPU 40 obtains the correction value for the sixth region. The sixth region is a region on the rear end 51B side of the platen 51, so interpolated values of two locations cannot be used. Therefore, the CPU 40 determines the correction value for YPOS5 to be the correction value for the sixth region. For example, the CPU 40 determines "+2/1200 (inch)" to be the correction value for the sixth region.

Next, the CPU 40 stores the correction values of the first region to the sixth region that have been determined by the ejection timing determination processing (step S5), in a register, not shown in the drawings, of the ASIC 18 (step S6). For example, the CPU 40 adds the correction values of the first region to the sixth region determined in the ejection timing determination processing (step S5), to the correction values of the ejection timings of the head portion 110 and the head portion 210 in the reciprocation printing in the main scanning direction that are already stored in the register of the ASIC 18. Then the CPU 40 ends the processing.

As described above, with the print device 1 of the first embodiment, the color ink is ejected at the timings of coordinate (−3), coordinate (−2), coordinate (−1), coordinate (0), coordinate (1), coordinate (2), and coordinate (3) in the X direction, at YPOS1 where the white ink was ejected on the test sheet, in the test printing (step S2). Also, the color ink is ejected at the timings of coordinate (−3), coordinate (−2), coordinate (−1), coordinate (0), coordinate (1), coordinate (2), and coordinate (3) in the X direction, at YPOS2 where the white ink was ejected, in the test printing (step S2). The print device 1 can receive, via the operation buttons 46, one timing at which the deviation of the landing position of the color ink with respect to the landing position of the white ink is relatively reduced, at YPOS1 to YPOS5. Therefore, the print device 1 can reduce the deviation of the landing position of the color ink with respect to the landing position of the white ink, at YPOS1 to YPOS5. Therefore, even if the positions of the head portion 110 and the head portion 210 deviate from predetermined positions due to bending or the like of the guide rails 11 and 12, deviation of the landing position of the color ink with respect to the landing position of the white ink can be reduced with the print device 1.

Also, the print device 1 prints the correction pattern 60 by ejecting both the white ink and the color ink in the X direction of the YPOS1 to the YPOS5, in the test printing step (step S2) shown in FIG. 5, within the range where the platen 51 is positioned below the head portion 110 or the head portion 210, as shown in FIG. 3. Therefore, the print device 1 can reduce the deviation of the landing position of the color ink with respect to the landing position of the white ink, at YPOS1 to YPOS5, and the first region to the sixth region, within the range where the platen 51 is positioned below the head portion 110 or the head portion 210.

Also, the print device 1 prints the correction pattern 60 by ejecting both the white ink and the color ink in the X direction of YPOS1 to YPOS5, in the test printing step (step S2) shown in FIG. 5, within the range from the position where the front end 51A of the platen 51 in the Y direction, which is the moving direction of the platen 51, is positioned below the head portion 110 to the position where the rear end 51B of the platen 51 is positioned below the head portion 210, as shown in FIG. 3. Therefore, the print device 1 can reduce the deviation of the landing position of the color ink with respect to the landing position of the white ink, at YPOS1 to YPOS5 and the first region to the sixth region, in the range from the position where the front end 51A of the platen 51 in the Y direction, which is the moving direction of the platen 51, is positioned below the head portion 110 to the position where the rear end 51B of the platen 51 is positioned below the head portion 210.

The first rectangle 61 and the second rectangle 62 of the correction pattern 60 that the CPU 40 prints in the test printing (step S2) (refer to FIG. 6 to FIG. 8) are rectangles of the same size and shape, and have sides extending in the main scanning direction (X direction) and the sub-scanning direction (Y direction), so deviation of the landing positions in each of the main scanning direction (X direction) and the sub-scanning direction (Y direction) is easy to see.

The head portion 110 and the head portion 210 are placed on the single carriage 20 as shown in FIG. 2, so compared to a case where the head portion 110 and the head portion 210 are placed on a plurality of carriages, the origins only need to be aligned once.

Figure 4:
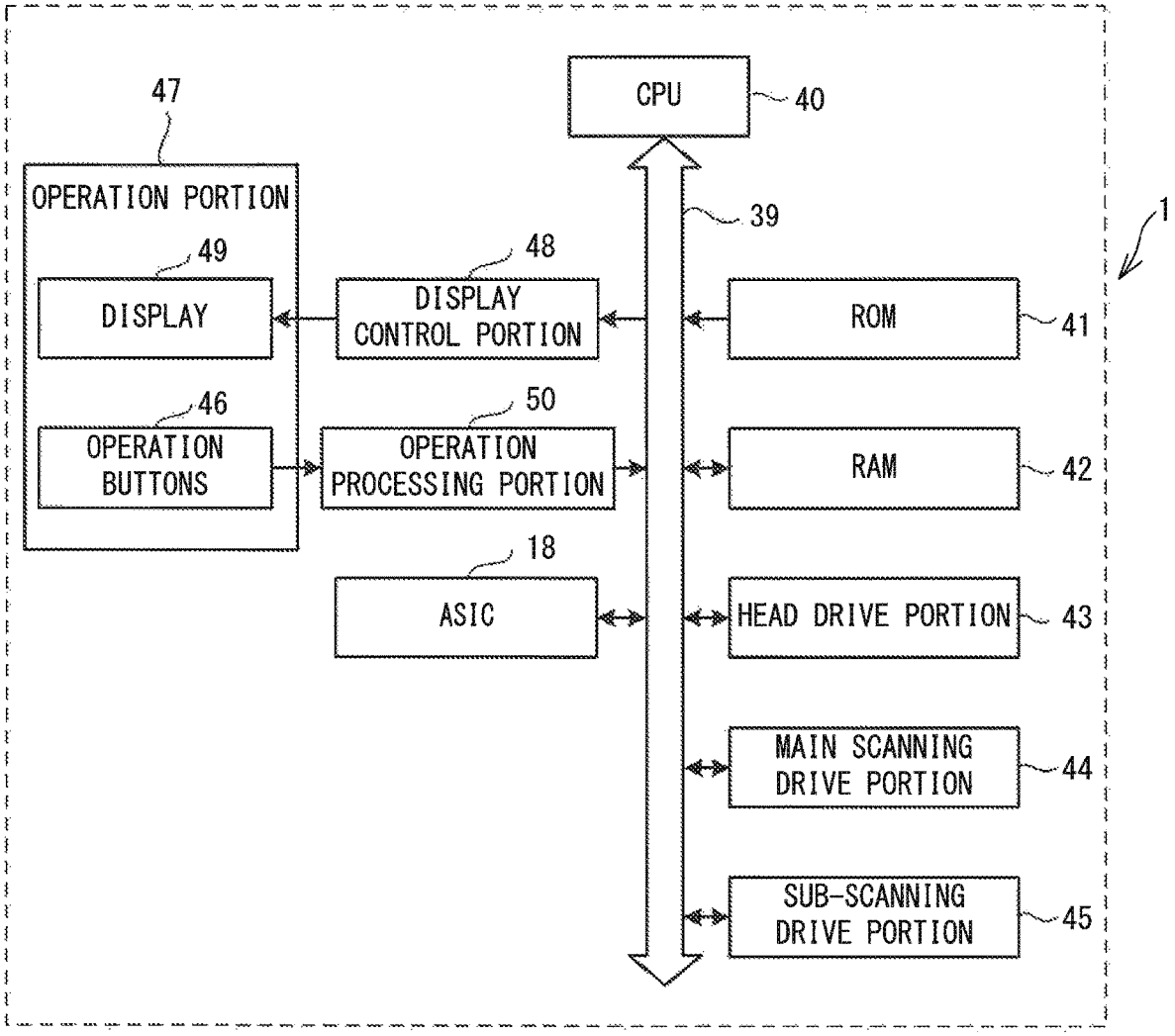
FIG. 4 is a block diagram illustrating an electrical configuration of the print device.
Figure 5:
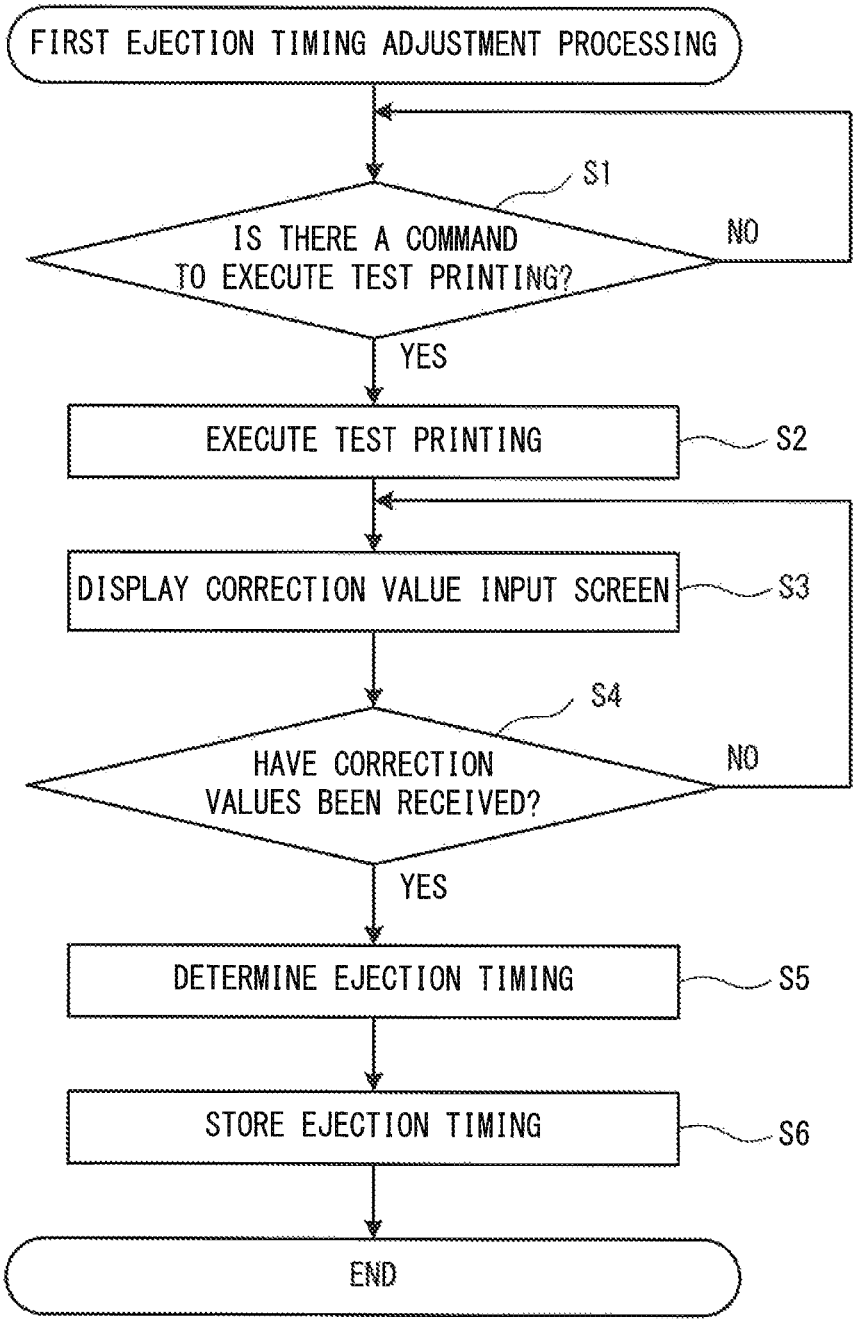
FIG. 5 is a flowchart of first ejection timing adjustment processing.

In the processing of step S4 shown in FIG. 5, because the ejection timing of the head portion 210 can be input using the operation buttons 46 shown in FIG. 1 and FIG. 4, input can be performed manually, which obviates the need to provide a reading portion, so there is greater flexibility.

In the processing of step S5 shown in FIG. 5, the CPU 40 determines, through interpolation processing, the ejection timings of color ink at the second region between YPOS1 and YPOS2, the third region between YPOS2 and YPOS3, the fourth region between YPOS3 and YPOS4, and the fifth region between YPOS4 and YPOS5. Therefore, deviation of the landing position of the color ink with respect to the landing position of the white ink can also be reduced in the regions for which a correction value is not received.

Note that with the print device 1, there are cases where there is feed error caused by bending in the height direction, pitch error of a belt, not shown in the drawings, of the platen drive mechanism 6, or eccentricity of a pulley, or the like. This this case, the CPU 40 can reduce the deviation of the landing position of the color ink with respect to the landing position of the white ink, by making a correction in the Y direction similar to that in the X direction described above.

Second Embodiment

Next, a second embodiment of the present disclosure will be described. The print device 1 according to the second embodiment includes an image scanner (not shown in the drawings) that reads a test sheet after printing the correction pattern 60. The other configuration is the same as the configuration of the print device 1 of the first embodiment, so a description thereof will be omitted. The image scanner is provided in a position able to read the test sheet after printing. The image scanner is formed from a charge-coupled device (CCD) or a contact image sensor (CIS) or the like. For example, the CCD may be provided in the carriage 20.

Figure 10:
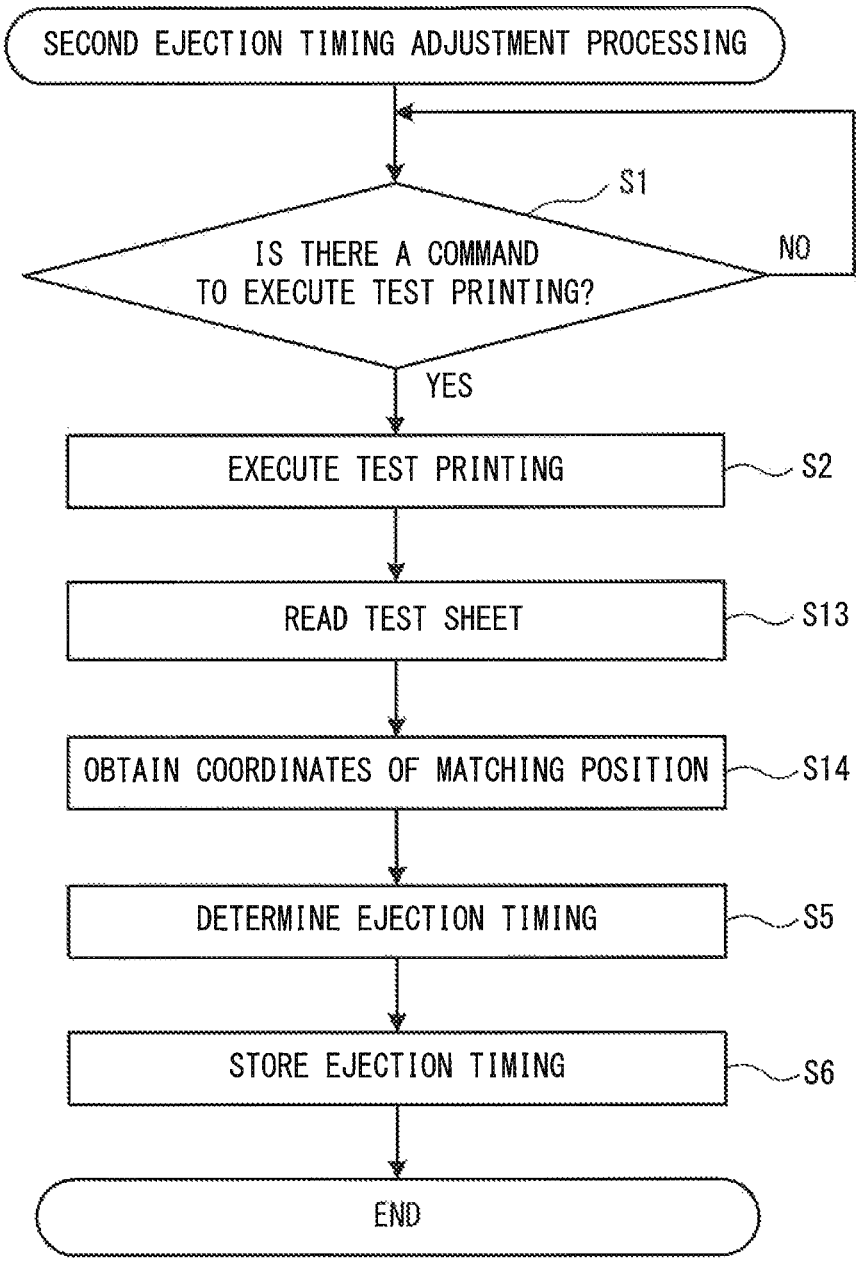
FIG. 10 is a flowchart of second ejection timing adjustment processing.

Second ejection timing adjustment processing of the second embodiment will be described with reference to FIG. 10. In the print device 1 of the second embodiment, the CPU 40 executes the processing of step S13 and S14 shown in FIG. 10, instead of the processing of step S3 and S4 in the flowchart shown in FIG. 5. In the flowchart shown in FIG. 10, processing of the same number as the step number in the flowchart shown in FIG. 5 is the same processing. First, the CPU 40 performs the processing of step S1 and step S2. The processing of step S1 and step S2 is the same processing as the processing of step S1 and step S2 of the first ejection timing adjustment processing, so a description thereof will be omitted.

Next, the CPU 40 reads, with the image scanner, the test sheet printed by the test printing (step S13). For example, the CPU 40 controls the sub-scanning drive portion 45 to move the platen 51 to a print start position. The CPU 40 drives the main scanning drive portion 44 to move the carriage 20 in a reciprocating manner in the main scanning direction, and controls the sub-scanning drive portion 45 to move the platen 51 in the sub-scanning direction, and reads, with the image scanner, the correction pattern 60 printed on the test sheet.

Next, the CPU 40 obtains the coordinates of the matching position (step S14). That is, the CPU 40 identifies the coordinates of the matching position where the second rectangle 62 overlaps directly over the first rectangle 61 in the X direction at each position of YPOS1 to YPOS5 of the correction pattern 60, read from the test sheet by the image scanner. For example, the CPU 40 identifies a portion having a lower lightness than the surroundings as the matching position. Therefore, the CPU 40 obtains the X coordinates (−3 to 3) of the first rectangle 61 and the second rectangle 62 in a position having the lowest lightness, in the X direction, at each of YPOS1 to YPOS5.

Next, the CPU 40 determines the ejection timing (step S5) and stores the ejection timing (step S6). The determination of the ejection timing (step S5) is the same as the processing of step S5 of the first embodiment, and the storing of the ejection timing (step S6) is the same as the processing of step S6 of the first embodiment, so descriptions thereof will be omitted.

As described above, the print device 1 of the second embodiment is able to identify the position where the second rectangle 62 overlaps directly over the first rectangle 61 and receive the correction value by reading, with the image scanner, the test pattern printed on the test sheet.

Note that the present invention is not limited to the embodiments described above and can be modified in a variety of ways. For example, the first rectangle 61 and the second rectangle 62 of the correction pattern 60 are indicated only by lines which define their borders (i.e., the insides of the rectangles are transparent). However, when the test sheet is cloth, the first rectangle 61 and the second rectangle 62 may be solid (i.e., filled in with color) to make them easier to see. There are seven rows and seven columns of the first rectangle 61 and the second rectangle 62 of the correction pattern 60. However, the number of rows and columns is not limited to seven, but may be an appropriate number. The first rectangle 61 and the second rectangle 62 are not limited to being square, and may be rectangular such as oblong. Also, the landing position of the second rectangle 62 of the correction pattern 60 deviates from the first rectangle 61 in increments of 2/1200 (inch) as the coordinates move up, down, left, and right from the coordinates (0, 0), but the amount of movement is not limited to increments of 2/1200 (inch), and may be set according to the resolution of the print device 1, e.g., 1/1200. Also, the region on the platen 51 is divided into six regions, i.e., the first region to the sixth region, by YPOS1 to YPOS5. However, the region on the platen 51 does not always have to be divided into six, and may be divided into any appropriate number. Also, the widths in the Y direction of each region from the second region to the fifth region do not have to be the same. Further, the widths in the Y direction of all of the first region to the sixth region may be the same. Also, the interpolation processing is not limited to linear interpolation; any of a variety of interpolation methods can be used. For example, secondary interpolation or tertiary interpolation or the like may be used. Also, the region where the landing position of the color ink is corrected with respect to the landing position of the white ink is not limited to the region on the platen 51; a region extending in the up-down direction (Y direction) on the platen 51 may be corrected.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a first head that moves in a main scanning direction and ejects a first ink;

a second head that moves in the main scanning direction and ejects a second ink;

a platen on which a recording medium is placed;

a guide member that extends in a sub-scanning direction and guides the platen in the sub-scanning direction;

a receiving portion that receives an ejection timing of the second ink;

a processor; and a memory that stores computer-readable instructions that, when executed by the processor, cause the print device to perform processes including:

test printing that involves printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and determining that involves, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

2. The print device according to claim 1, wherein in the test printing, the test pattern is printed by ejecting the second ink at the first timing and the second timing, at the first sub-scanning direction position where the first ink was ejected, within a range where the platen is positioned below the first head or the second head, and further, ejecting the second ink at the third timing and the fourth timing, at the second sub-scanning direction position where the first ink within the range was ejected.

3. The print device according to claim 1, wherein in the test printing, the test pattern is printed by ejecting the second ink at the first timing and the second timing, at the first sub-scanning direction position where the first ink was ejected, within a range from a position where a front end of the platen in the movement direction of the platen is positioned below the first head, to a position where a rear end of the platen is positioned below the second head, and further, ejecting the second ink at the third timing and the fourth timing, at the second sub-scanning direction position where the first ink within the range was ejected.

4. The print device according to claim 1, wherein in the test printing, a first rectangle having sides extending in the main scanning direction and the sub-scanning direction is printed with the first ink, and a second rectangle that is the same size and shape as the first rectangle and having sides extending in the main scanning direction and the sub-scanning direction is printed with the second ink.

5. The print device according to claim 1, further comprising:

one carriage that moves in the main scanning direction, wherein the first head and the second head are placed on the carriage.

6. The print device according to claim 1, wherein the receiving portion is an input portion into which the ejection timing of the second ink is input by an operator.

7. The print device according to claim 1, wherein the ejection timing of the second ink between the first sub-scanning direction position and the second sub-scanning direction position is determined by interpolation processing the ejection timing of the second ink in the first sub-scanning direction determined by the determining, and the ejection timing of the second ink in the second sub-scanning direction position determined by the determining.

8. A control method for a print device including a first head that moves in a main scanning direction and ejects a first ink, a second head that moves in the main scanning direction and ejects a second ink, a platen on which a recording medium is placed, a guide member that extends in a sub-scanning direction and guides the platen in the sub-scanning direction, a receiving portion that receives an ejection timing of the second ink, and a processor, the control method comprising:

a test printing step of printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and a determining step of, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

9. A non-transitory computer-readable medium storing computer-readable instructions that, when executed by a processor of a print device including a first head that moves in a main scanning direction and ejects a first ink, a second head that moves in the main scanning direction and ejects a second ink, a platen on which a recording medium is placed, a guide member that extends in a sub-scanning direction and guides the platen in the sub-scanning direction, a receiving portion that receives an ejection timing of the second ink, and the processor, cause the print device to perform processes including:

test printing that involves printing a test pattern by ejecting the second ink at a first timing and a second timing at a first sub-scanning direction position where the first ink was ejected, and further, ejecting the second ink at a third timing and a fourth timing at a second sub-scanning direction position where the first ink was ejected; and determining that involves, when one of the first timing and the second timing is received by the receiving portion, determining the received timing to be the ejection timing of the second ink at the first sub-scanning direction position, and, when one of the third timing and the fourth timing is received by the receiving portion, determining the received timing to be the ejection timing of the second ink at the second sub-scanning direction position.

* * * * *